United States Patent [19]

Edwards et al.

[11] Patent Number: 4,817,710

[45] Date of Patent: Apr. 4, 1989

[54] APPARATUS FOR ABSORBING SHOCK

[75] Inventors: A. Glen Edwards, Hockley; David S. Wesson, Katy, both of Tex.; Emmet F. Brieger, Nogal, N. Mex.

[73] Assignee: Halliburton Company, Duncan, Okla.

[21] Appl. No.: 74,586

[22] Filed: Jul. 17, 1987

Related U.S. Application Data

[62] Division of Ser. No. 740,927, Jun. 3, 1985, Pat. No. 4,693,317.

[51] Int. Cl.[4] ..... E21B 17/07; G01D 11/10

[52] U.S. Cl. ..... 166/242; 73/431; 166/113

[58] Field of Search ..... 166/242, 250, 113, 117.5, 166/55, 55.1, 297; 73/11, 151, 430, 431

[56] References Cited

U.S. PATENT DOCUMENTS 2,577,599 12/1951 Bethancourt ..... 73/431 X
3,149,490 9/1964 Clements et al. ..... 73/151
3,714,831 2/1973 Quichaud et al. ..... 73/431
4,467,866 8/1984 Vazquez et al. ..... 166/117.5
4,628,995 12/1986 Young et al. ..... 166/242 X

*Primary Examiner*—Jerome W. Massie, IV
*Assistant Examiner*—David J. Bagnell
*Attorney, Agent, or Firm*—James R. Duzan; Michael L. Lynch

[57] ABSTRACT

The present invention includes devices for absorbing shock in a tool string within a borehole. These components may serve together in a variety of configurations to form a shock absorbing system. A longitudinal shock absorber is connected in the tool string. The longitudinal shock absorber includes compressible members utilized to damp longitudinal movement. A radial shock absorber is connected in the tool string. The radial shock absorber includes resiliently mounted contact pads for contacting the sides of the borehole to damp radial movement. A carrier assembly is utilized to provide a shock absorbing mounting for particularly delicate components such as gauges, and to damp any shock which might be transmitted thereto from either a radial or longitudinal direction.

7 Claims, 11 Drawing Sheets

APPARATUS FOR ABSORBING SHOCK

This application is a division of application Ser. No. 740,927, filed June 3, 1985 now U.S. Pat. No. 4,693,317.

BACKGROUND OF THE INVENTION

The present invention relates generally to methods and apparatus for absorbing shock, and more particularly relates to methods and apparatus for absorbing shock in equipment utilized in earth boreholes in the oil and gas industry.

In many applications in the oil and gas industry, there is a need to protect systems utilized in earth boreholes from shock. For example, one such application is during the completion or testing of oil and gas wells, when the wells are either completed or tested through the use of perforating guns. In a common type of well completion operation, a perforating gun will be run into an earth borehole on the tubing string. In addition to the perforating gun, it is not uncommon to include other equipment for controlling or monitoring the well during the completion operation. For example, measurement devices such as temperature and pressure recorders may be included in the tool string. Additionally, the tool string may include other equipment associated with the well completion or testing operation, such as gravel packing tools, vent assemblies or packers.

The perforating guns typically carry a plurality of explosives, such as shaped charges, designed to penetrate the earth formation surrounding the borehole. The detonation of these explosives will generate a reaction or "recoil" in the tool string which will tend to accelerate the string both radially, or horizontally, within the borehole, as well as longitudinally, or vertically, within the borehole. Accelerations of the tool string can be both high and low frequency. Acoustic vibrations can be transmitted both directly through the tool string to a vibration sensitive component or may be transmitted through borehole fluids to components in the tool string.

When the tool string includes additional devices, as described above, the shock transmitted to the string, either directly or indirectly, at the time of the detonation of the perforating gun increases the likelihood of damage to the devices. This is particularly true in the case of relatively delicate instruments such as the pressure or temperature recorders described above, or such as various types of electronic equipment which may be utilized within the well.

Accordingly, the present invention provides a new method and apparatus for isolating and absorbing shock in a borehole environment. The method and apparatus of the present invention are believed to have particular applicability in minimizing the transmission of shock caused by the detonation of tubing conveyed perforating guns from the tubing string and other equipment in the tool string.

SUMMARY OF THE INVENTION

The present invention provides method and apparatus for isolating and absorbing shock in a tool string within an earth borehole. The present invention encompasses a plurality of components particularly adapted to absorb such shock.

The present invention includes a longitudinal shock absorber which is particularly useful in damping longitudinal movement of a component within a tool string.

In one preferred embodiment, a longitudinal shock absorber in accordance with the present invention includes a mandrel which is adapted to couple to other components in the tool string. This mandrel is telescopingly received within a housing which is adapted to couple to other components in the tool string. Shock absorbing elements, such as compressible members, are situated in an annular area between the mandrel and the housing. Thrust shoulders are provided on both the mandrel and the housing such that movement of the mandrel relative to the housing in either direction will cause compression of at least one compressible member, progressively damping such longitudinal acceleration.

The present invention also encompasses a radial shock absorber for restricting radial movement of a tool string within a borehole. In a preferred embodiment, this radial shock absorber includes a support member adapted to couple at each end to other components of the tool string. The radial shock absorber includes a plurality of contact shoes which are reciprocatingly supported relative to the support member. These contact shoes are preferably resiliently mounted, such as by springs, such that they are urged radially outwardly relative to the support member. The contact shoes are arranged around the periphery of the radial shock absorber such that radial movement of the tool string in any direction will cause compression of the resilient medium urging the contact shoes outwardly, thereby cushioning, or damping, the radial acceleration of the tool string.

The present invention also includes a carrier for supporting gauges or other components, such as temperature or pressure recorders, within the borehole. In a preferred embodiment this carrier includes a cage structure which is conformed to support each gauge or other component in a shock absorbing medium, such as a relatively low resilience rubber compound. In one of these preferred embodiments, the carrier includes a plurality of shock absorbing segments, made, for example, from rubber, which are distributed over the length of the gauges or other components to restrict their motion and to prevent the gauges or other components from contacting the carrier housing. The gauges are also mounted such that a relatively low resilience member supports the gauges at either end so as to restrict movement and to damp longitudinal acceleration of the gauges.

The above-described components may be combined in various combinations, and in various numbers, to form shock absorbing systems offering optimal protection to components in a tool string. For example, a perforating gun or other device which may generate sudden forces, and therefore shock, within the borehole may be coupled between two longitudinal shock absorbers to damp movement of the perforating gun relative to components both above and below the perforating gun. Additionally, a radial shock absorber may be provided proximate the perforating gun to restrict radial movement of the tool string in response to the detonation of the perforating gun. The carrier may be utilized to support delicate devices such as temperature or pressure gauges or electronic equipment and optimally protect the devices. In most systems, the carrier will preferably be located on the opposite side of one of said longitudinal shock absorbers from the perforating gun.

The use of shock absorbing components such as the longitudinal shock absorber and the radial shock absorber, either individually or as a part of a system as described above, helps to minimize the likelihood of damage to the integrity and operation of the tool string. For example, shocks such as those occurring as the result of the detonation of perforating guns have been known to cause the unsetting of previously set packers or the uncoupling of tubing joints. The use of longitudinal shock absorbers and/or radial shock absorbers, as disclosed herein, provides optimal protection from such damage.

DETAILED DESCRIPTION OF A PREFERRED EMBODIMENT

Figure 1:
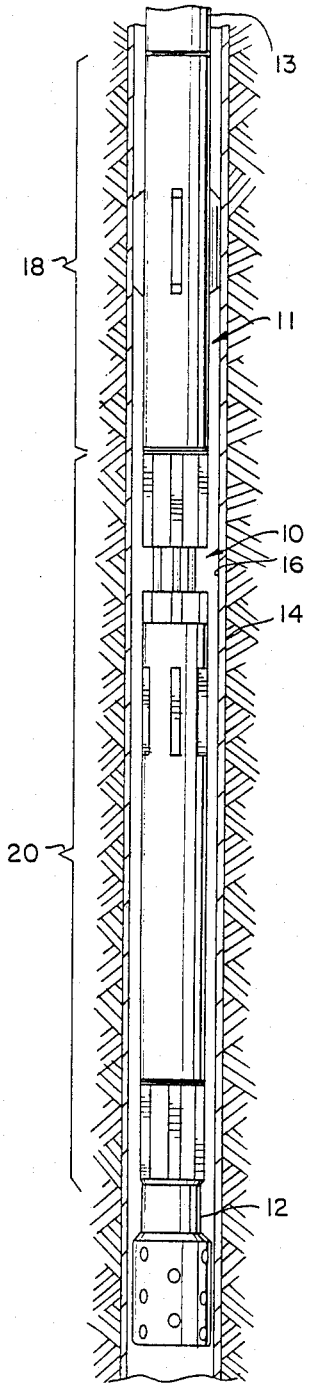
FIG. 1 depicts a shock absorbing system in accordance with the present invention, and including both radial and longitudinal shock absorbers, in association with a tubing conveyed perforating gun.

Referring now to the drawings in more detail, and particularly to FIG. 1, therein is illustrated a shock absorber system 10 in accordance with the present invention, illustrated as a part of a tool string 11 including tubing string 13 and a tubing conveyed perforating gun 12 and situated within an earth borehole 14. In the illustrated environment, earth borehole 14 has been lined with casing 16 which will typically be secured in place by cement (not shown) in a conventional manner. All or part of shock absorber system 10, however, may also be advantageously utilized in uncased boreholes. Additionally, all or part of shock absorber system 10 may also advantageously be utilized outside of a tubing-conveyed string, such as, for example, in conjunction with a wireline-conveyed perforating gun.

Shock absorbing system 10 includes a radial shock absorber 18 and a longitudinal shock absorber 20. In operation of the system depicted in FIG. 1, upon detonation of perforating gun 12, longitudinal shock absorber 20 will primarily absorb or damp longitudinal recoil of perforating gun 12 while radial shock absorber 18 will damp radial accelerations of tubing string 13.

Figure 2A:
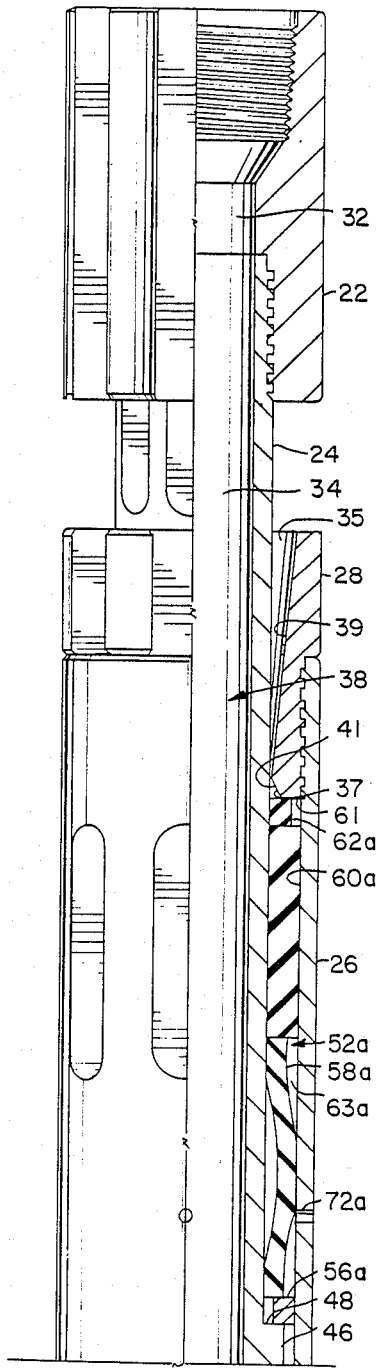
FIGS. 2A–B depict the longitudinal shock absorber of FIG. 1, illustrated in one-quarter cross-section.
Figure 2B:
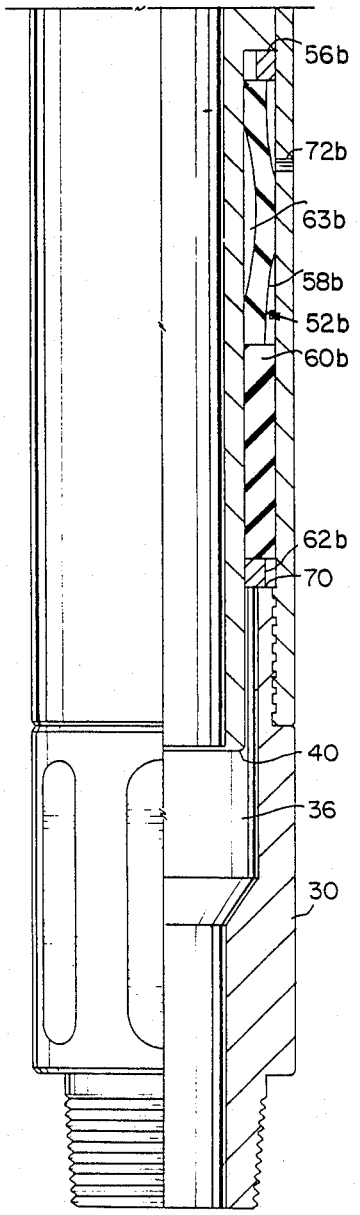

Referring now to FIGS. 2A–B, therein is illustrated longitudinal shock absorber 20 of FIG. 1, depicted in quarter-sectional view. Longitudinal shock absorber 20 includes a box connector 22 adapted to provide a mechanical coupling between longitudinal shock absorber 20 and tubing string 13. Box connector 22 is threadably coupled to a mandrel 24. Mandrel 24 is telescopingly retained within a generally tubular housing 26.

A pin connector 30 is threadably secured to housing 26 at the lower end thereof. Pin connector 30 facilitates the attachment of longitudinal shock absorber 20 to other equipment, such as a perforating gun (item 12 in FIG. 1). Pin connector 30 is internally configured such that it will not interfere with the movement of lower end 40 of mandrel 24 as mandrel 24 telescopes within housing 26. As will be apparent from the discussion to follow, mandrel 24 cooperatively is retained within housing 26 by endcap 28, box connector 22 and pin connector 30.

Box connector 22, mandrel 24, endcap 28, and pin connector 30, each preferably include aligned longitudinal apertures 32, 34, 35, and 36, respectively. Longitudinal apertures 32, 34, and 36 cooperatively define a passageway 38 through longitudinal shock absorber 20. Passageway 38 provides a path through which mechanisms or fluids may be traversed either uphole or downhole.

Aperture 35 through endcap 28 is defined by surfaces 37 and 39 which meet to form a pivot pin 41. Pivot point 41 is radially dimensioned to contact mandrel 24 in response to radial movement of housing 26. Optimally, this contact will allow box connector 22 and mandrel 24, and the portion of tool string 11 above longitudinal shock absorber 20, to remain generally stationary while axial loading and motion in longitudinal shock absorber 20 is damped in response to the pivoting of housing 26 and attached endcap 28 around pivot point 41.

As shown in FIGS. 2A–B, box connector 22, mandrel 24, endcap 28, housing 26, and pin connector 30 each preferably contain "flats", as illustrated at 44, to facilitate the makeup or breakout of the described and illustrated threaded connections.

Mandrel 24 is a generally tubular member having a radially extending shoulder 46 extending therefrom. An upper shock absorbing bumper assembly **52*a* is situated concentric to mandrel 24 and above shoulder 46. Similarly, a lower shock absorbing bumper assembly 52*b* is situated concentric to mandrel 24 and below shoulder 46. Upper and lower bumper assemblies 52*a*, 52*b* contain identical elements arranged symmetrically relative to shoulder 46. Accordingly, although only the elements of upper bumper assembly 52*a* will be described in detail, it will be understood that the elements of lower bumper assembly 52*b***, identified as "[numeral]b" are structurally and functionally identical.

Situated adjacent to shoulder 46 is large retainer ring **56*a*. Large retainer ring 56*a* is preferably formed of a rigid, nondeformable material such as steel. Large retainer ring 56*a* preferably has an outer diameter which is proximate the inner diameter of housing 26. Large retainer ring 56*a*, however, has an inner diameter which is substantially larger than the outer diameter of mandrel 24, so as to provide an annular gap between large retainer ring 56***a* and mandrel 24 when the two pieces are axially aligned. In one preferred embodiment wherein mandrel 24 has an outer diameter of 3.0 inches and housing 26 has an inner diameter of approximately 4.38 inches, large retainer ring 56*a* has an inner diameter of 3.38 inches.

Adjacent to large retainer ring 56*a* is compressible bumper 58*a*. Compressible bumper 58*a* is preferably made of a relatively low-resilience rubber compound. In one preferred embodiment, compressible bumper 58*a* is formed of 80 durometer peroxide-cured Hycar, identified as a 1091-50 rubber compound. Compressible bumper 58*a* is a tubular member having an inner diameter proximate the outer diameter of mandrel 24 but having an outer diameter which is substantially less than the inner diameter of housing 26. In the preferred embodiment having the dimensions described above, compressible bumper 58*a* has an outer diameter of 3.85 inches.

Adjacent compressible bumper 58*a* is radial bumper 60*a*. Radial bumper 60*a* is preferably formed of the same rubber compound as that of which compressible bumper 58*a* is formed. Radial bumper 60*a* is a tubular member which is preferably sized to substantially fill the annular gap between mandrel 24 and housing 26.

Adjacent radial bumper 60*a* is small retaining ring 62*a*. Small retaining ring 62*a* is preferably formed of a rigid, nondeformable material such as steel. Small retaining ring 62*a* has an inner diameter which is proximate the outer diameter of mandrel 24 and an outer diameter which is substantially less than the inner diameter of housing 26. In the embodiment having the dimensions as discussed earlier herein, small retaining ring 62*a* has an outer diameter of 4.0 inches. Small retaining ring 62*a* contacts, and rests adjacent, shoulder 61 of end cap 28. Upper shock absorbing assembly 52*a* is thus retained between shoulder 46 of mandrel 24 and end cap 28 secured to housing 26. Shoulder 46 of mandrel 24 and shoulder 61 of end cap 28 provide opposing shoulder surfaces for transmitting force through upper shock absorber assembly 52*a*.

Referring now to lower shock absorbing bumper assembly 52*b*, small retainer ring 62*b* rests adjacent a shoulder 70 of pin connector 30. Shoulder 70 of pin connector 30 and shoulder 46 of mandrel 24 thereby provide opposing surfaces through which force may be transmitted between pin connector 30, attached to housing 26 and mandrel 24, through lower shock absorbing assembly 52*b*. A pair of apertures 72*a*, 72*b* are provided in housing 26, positioned one to either side of the resting position of shoulder 46.

Shock will be absorbed in longitudinal shock absorber 20 through the longitudinal movement of housing 26 relative to mandrel 24 against the resistance of either upper or lower shock absorbing assembly 52*a* or 52*b*. Upper and lower shock absorber assemblies 52*a*, 52*b* are preferably conformed such that compressible bumpers 58*a* and 58*b* will be under load when longitudinal shock absorber 20 is not subjected to external loading. The longitudinal travel, or telescoping, of mandrel 24 relative to housing 26 is determined primarily by the relation of the volume of compressible bumpers 56*a*, 56*b* relative to the volume of the annular space which each bumper fills. In the preferred embodiment having the dimensions as described earlier herein, longitudinal shock absorber 20 is conformed to facilitate approximately 4 inches travel between mandrel 24 and housing 26. Thus, from a neutral, or "rest", position, mandrel 24 may move 2 inches in either direction relative to housing 26.

Figure 3:
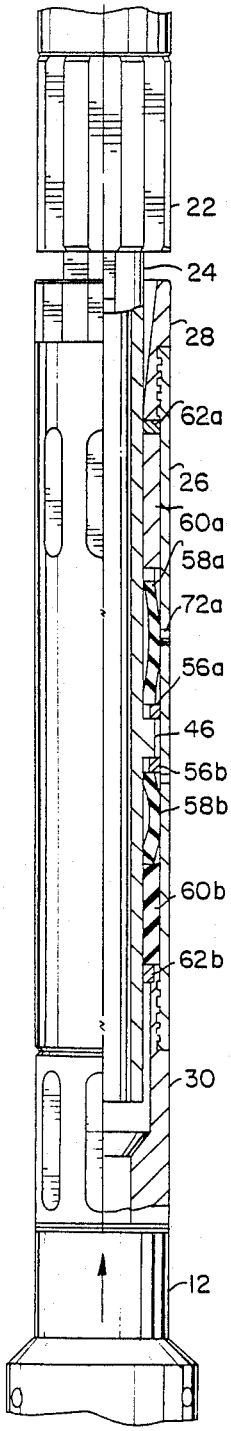
FIG. 3 depicts the longitudinal shock absorber of FIGS. 1 and 2 in an operating configuration, also illustrated in a one-quarter cross-section.

Referring now also to FIG. 3, therein is shown longitudinal shock absorber 20 in an operating configuration, with housing 26 moved upwardly for approximately one-half of its available travel relative to mandrel 24. As indicated earlier herein, compressible bumpers 58*a*, 58*b* are preferably configured such that when mandrel 24 is in a rest position relative to housing 26, compressible bumpers 58*a*, 58*b* are each under partial load. Compressible bumpers 58*a* or 58*b* are also preferably sized that such 2 inches movement in either direction will cause one compressible bumper 56*a*, 56*b* to be fully compressed into the annulus between mandrel 24 and housing 26, and will allow the other compressible bumper 56*a*, 56*b* to be fully relaxed.

In operation, as can be seen in FIG. 3, as housing 26 moves upwardly relative to mandrel 24, compressible bumper 58*b* begins to extrude to fill annulus 63*b*. Pressure relief port 72*b* is preferably situated such that as shoulder 46 and large retaining ring 56*b*, of shoulder 70 moves toward box connector 30, causing compressible bumper 58*b* to extrude, large retaining ring 56*b* will cover port 72*b* before compressible bumper 58*b* will extrude through port 72*b*.

As housing 26 moves upward relative to mandrel 24, and compressible bumper 58*b* compresses, compressible bumper 58*a* relaxes. It will be readily appreciated that a downward movement of housing 26 relative to mandrel 24 will cause opposite reactions in compressible bumpers 58*a* and 58*b*. Longitudinal shock may be imparted to tool string 11 in either an upward or downward direction. Such shock may also initiate a generally oscillating motion in tool string 11. Shock absorber 20 is therefore designed to damp acceleration in either longitudinal direction.

Radial bumpers 60*a*, 60*b* absorb radial "whipping", or shock, between mandrel 24 and housing 26. The gaps between large retaining rings 56*a*, 56*b* and mandrel 24; and the gaps between small retaining rings 62*a*, 62*b* and housing 26, facilitate the pivoting action of housing 26 relative to mandrel 24. With the exception of the contact between mandrel 24 and pivot point 41 of endcap 28, there is preferably no metal-to-metal contact between mandrel 24 and housing 26 or components coupled thereto. In connection with avoiding this metal-to-metal contact, and resulting shock, the longitudinal apertures through pin connector 30 and endcap 28, except at pivot point 41, are preferably sized to avoid contact with mandrel 24 as mandrel 24 moves within the range allowed by radial bumpers 60*a*, 60*b*.

Figure 4A:
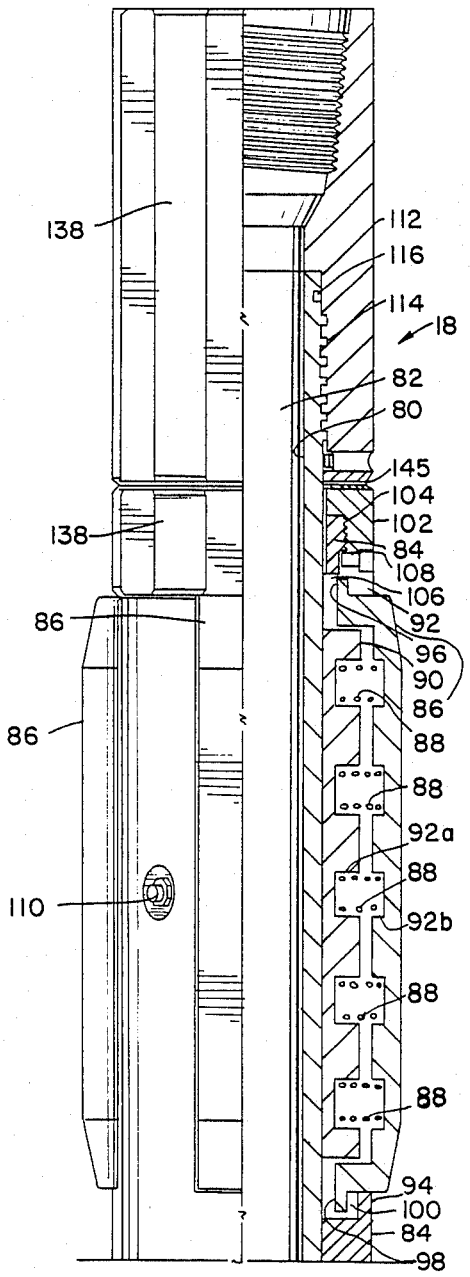
FIGS. 4A–B depict the radial shock absorber of FIG. 1, illustrated in one-quarter cross-section.
Figure 4B:
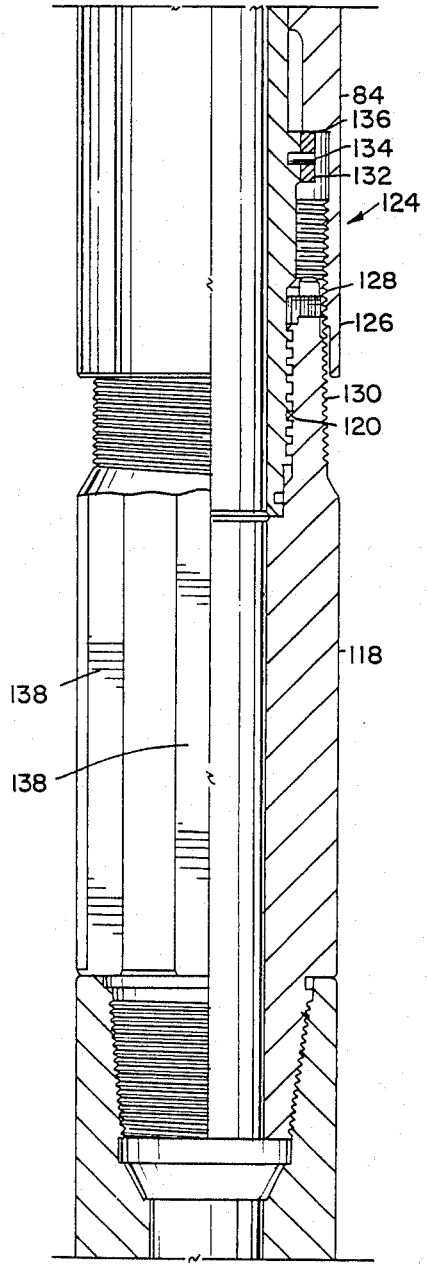

Referring now to FIGS. 4A–B, therein is shown radial shock absorber 18 of FIG. 1 in greater detail, illustrated in quarter-sectional view. Radial shock absorber 18 includes a generally tubular mandrel 80 having a longitudinal aperture 82 therethrough. A generally tubular housing 84 is situated concentric to mandrel 80. Radial shock absorber 18 includes a plurality of drag shoes 86 which extend radially relative to housing 84. In one preferred embodiment, radial shock absorber 18 includes four drag shoes 86. Drag shoes 86 are reciprocatingly mounted relative to mandrel 80 and are urged toward the outer extent of their radial travel relative to mandrel 80. In a particularly preferred embodiment, a plurality of springs 88 are utilized to urge drag shoes 86 radially outwardly relative to mandrel 80. A plurality of spring carrier blocks 90, are each located between a respective drag shoe 86 and mandrel 80 in an aperture 91 in housing 84. Each of the spring carrier blocks 90 is cooperatively formed with a respective drag shoe 86 such that each drag shoe 86 will cooperatively engage its respective spring carrier block 90. The plurality of springs 88 are retained between a spring carrier block 90 and an associated drag shoe 86 and are utilized to exert an outwardly radial force on such drag shoes 86.

In a particularly preferred embodiment, each drag shoe 86 is urged radially outwardly by five coil springs 88. Springs 88 are preferably retained within opposing recesses **92*a*, 92*b*, in spring carrier block 90 and drag shoes 86, respectively. Springs 88 may be selected according to anticipated operating conditions. In one particularly preferred embodiment, springs 88 have been selected such that each drag shoe 86 is loaded by springs 88 to an initial preload force of 74 pounds. In this particularly preferred embodiment, springs 88 are selected such that a maximum travel of any one drag shoe 86 toward mandrel 80 will require a total force of approximately 375 pounds on that drag shoe 86. Also in this preferred embodiment, the maximum travel of each drag shoe 86** is approximately 0.9 inches.

Drag shoes 86 are retained in radial shock absorber 18 by opposing upper and lower lip assemblies, 92 and 94 respectively. Upper and lower lip assemblies 92 and 94 restrain complementary upper and lower lip assemblies 96 and 98 on drag shoe 86. Lower housing lip assembly 94 extends from housing 84 and defines a recess 100 between lower lip 94 and mandrel 80. Lower lip 98 of drag block 86 is free to move within recess 100.

Upper lip 96 of drag block 86 is retained by an upper lip assembly 92 on retaining cap 102. Retaining cap 102 is preferably secured by a threaded coupling 104 to housing 84. Upper lip assembly 92 is formed into retaining cap 102. Upper lip assembly 92, cooperatively with housing 84 defines a recess 106 in which lip 96 of drag shoe 86 may travel. When retaining cap assembly 102 is secured by threaded coupling 104 to housing 84, threaded coupling 104 is secured through use of a set screw 108 utilized in a conventional manner.

Retaining cap 102, housing 84, spring retention blocks 90 and drag shoes 86 form a unit which is free to rotate relative to mandrel 80. This freedom of rotation facilitates movement or rotational manipulation of tool string 11 within the borehole without undue friction from drag shoes 86 against the boundaries of the borehole. A thrust ring 115 is preferably situated between retainer cap 102 and box connector 112 to facilitate the free rotation of housing 84 and retainer cap 102 relative to box connector 112 and mandrel 80. A grease nipple 110 is preferably provided in housing 84 to facilitate the introduction of grease or another lubricant to facilitate the above-described rotation.

Radial shock absorber 18 includes an upper box connector 112 secured to mandrel 80 by a threaded coupling 114. A conventional O-ring seal 116 is preferably provided between mandrel 80 and box connector 112.

Radial shock absorber 18 includes a lower pin connector 118 which is secured to mandrel 80 by a threaded coupling 120. A conventional O-ring seal 122 is again preferably provided between pin connector 118 and mandrel 80. As depicted in FIGS. 4A–B, box connector 112, retainer cap 102, and pin connector 118 each include external flats, indicated generally at 138, to facilitate the making up and breaking out of the described threaded connections.

As discussed earlier herein, housing 84 and drag shoes 86 are rotationally mounted relative to mandrel 80. In a particularly preferred embodiment, radial shock absorber 18 includes an optionally threaded coupling assembly, indicated generally at 124. In threaded coupling assembly 124, the lower extension 126 of housing 84 includes a female threaded section 128. Lower pin connector 118 includes a male threaded section 130 appropriately configured to mate with female threaded section 128 on housing 84. Under normal operating conditions, housing 84 is retained in an upper, longitudinally spaced position from pin connector 118 such that female threaded section 128 and male threaded section 130 do not engage one another. Housing 84 is therefore free to rotate relative to mandrel 80 and pin connector 118. Housing 84 is preferably retained in this upper position by means of a shear ring 132 coupled to mandrel 80 by means of a shear pin 134. In one embodiment, shear pin 143 and shear ring 132 are designed to require 14,000 lbs. of force to shear. A thrust bearing 136 facilitates the rotation of housing 84 relative to shear ring 132.

Figure 5:
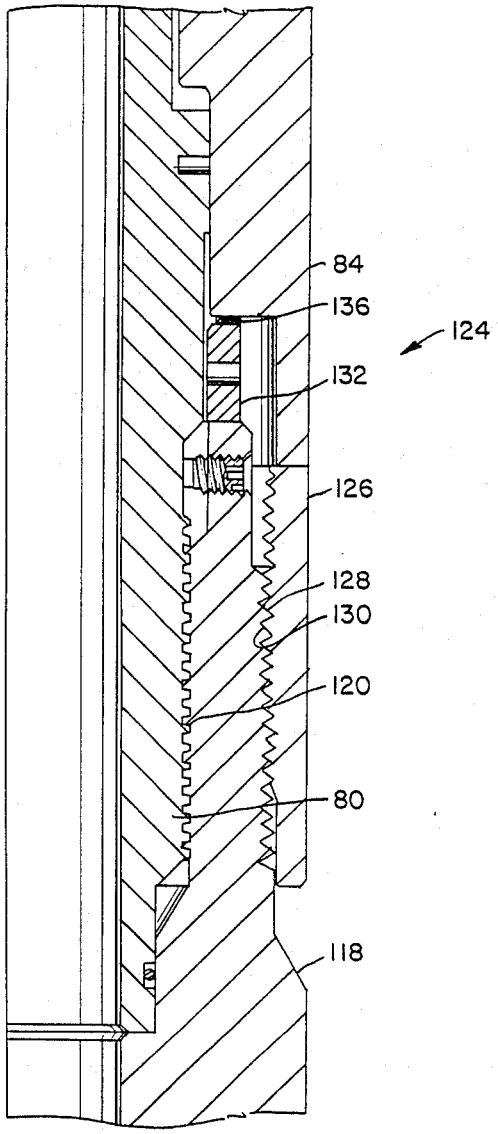
FIG. 5 depicts the selectively threadable coupling of the radial shock absorber of FIG. 4, illustrated in greater detail and in vertical section

Referring now also to FIG. 5, therein is illustrated emergency thread mechanism 124 in an actuated position, wherein housing 84 is nonrotatably secured relative to pin connector 118 and mandrel 80. In a typical operating situation, threaded coupling assembly 124 will be actuated by a downward force exerted on drag shoes 86. This downward force may be exerted by an overshot or fishing tool, as are well known in the oil and gas industry. Once this downward force exceeds the capacity of shear pin 134 and shear ring 132, the downward force will cause female threaded section 128 to be moved to a position proximate male threaded section 130. Thereafter, any rotation in the appropriate direction for the threads will cause female threaded section 128 and male threaded section 130 to threadally engage and thereby provide a secure coupling between housing 84 and pin connector 118. After such secure coupling is established, rotation may be applied to drag shoes 86, such as in a milling over operation.

In the operation of radial shock absorber 18, a radial force tending to move the tool string, including radial shock absorber 18 to one side in the borehole 10, will be damped by the compression of springs 88 supporting drag shoes 86. The action of the spring-loaded drag shoes 86 will dampen radial accelerations of tool string 11 and, within the limits of the compression range of such springs 88 as are acted upon, will minimize impacts of any portion of the tool string against casing 14.

Figure 6A:
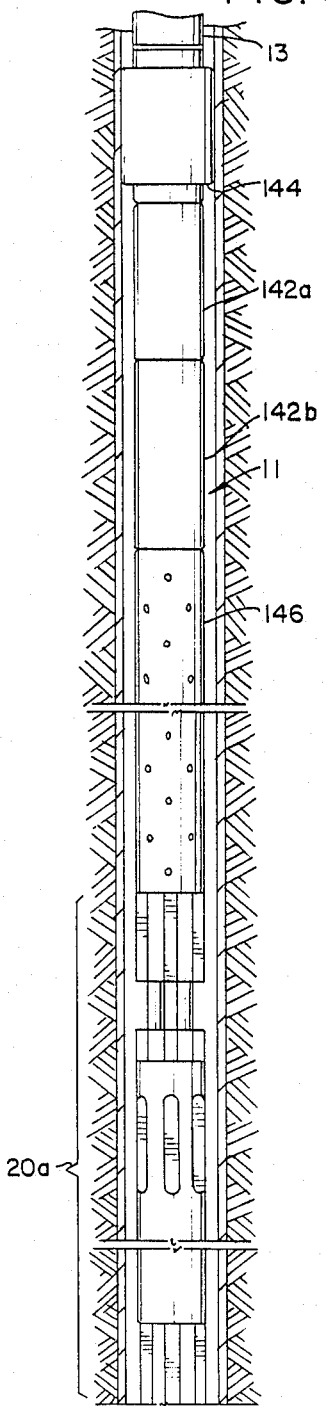
FIGS. 6A–C depict an alternative shock absorbing system in accordance with the present invention, including a plurality of longitudinal shock absorbers, a radial shock absorber, and a shock absorbing carrier.
Figure 6B:
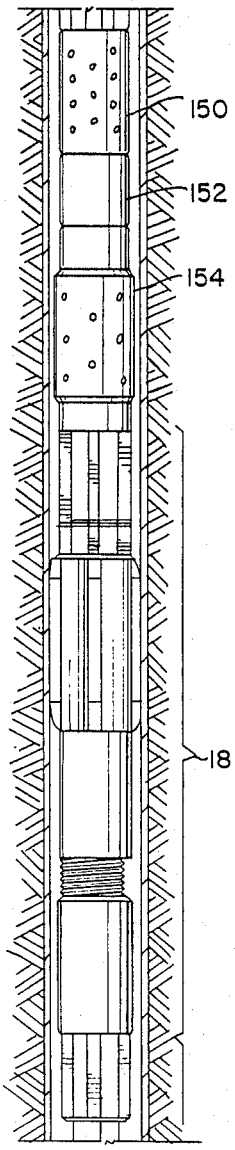
Figure 6C:
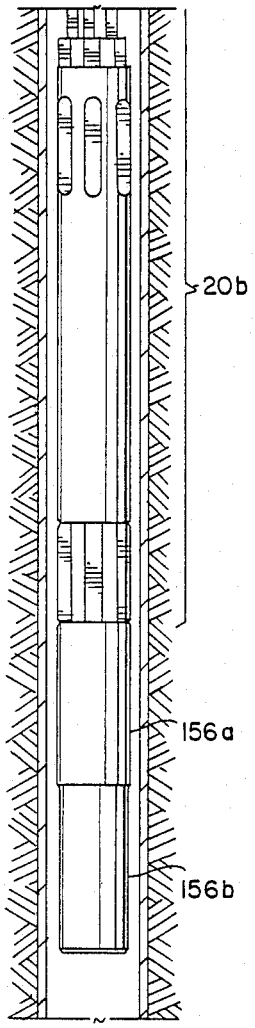

Referring now to FIGS. 6A–C, therein is illustrated another embodiment of a shock absorbing system 160 in accordance with the present invention. Shock absorbing system 160 contains components previously described herein which will be identified by the same numerals as previously utilized for those components.

Shock absorbing system 160 is depicted as depending from a tubing string 13. The tool string is depicted as including a packer 144 which may be of any conventional type. Coupled to packer 144 are a plurality of shock absorbing gauge carriers **142*a*, 142*b*. A length of perforated pipe at 146 is suspended from packer 144. Perforated pipe 146 is preferably a heavy weight drill pipe which is perforated where ever possible to facilitate fluid communication between the interior of the tool string and the borehole annulus surrounding the tool string. Perforated pipe 146** serves as a mass to help damp shock and further serves to space perforating gun 154 from packer 144. A longitudinal shock absorber 20 as previously described herein is coupled to perforated pipe 146. A perforated nipple 150 is coupled to longitudinal shock absorber 20*a*, again to facilitate fluid communication between the interior of tool string 140 and the borehole annulus surrounding the tool string 140. A perforating gun 154, and a conventional firing head 152 are suspended from perforated nipple 150. Coupled to the bottom of perforating gun 154 is radial shock absorber 18 having another longitudinal shock absorber 20*b* coupled thereto. At the lower end of the tubing string, coupled to longitudinal shock absorber 20*b* may be other pieces of equipment, such as, for example, conventional instruments or gauges 156*a*, 156*b*. Tool string 140 is exemplary of only one means of utilizing a shock absorbing system in accordance with the present invention. Those skilled in the art will appreciate that tool string 140 could include either fewer or additional components and could include components arranged in a different order than is depicted in FIGS. 6A–C.

Shock absorber system 160 includes radial shock absorber 18 located adjacent, and preferably below perforating gun 154. Shock absorber system 160 then preferably includes longitudinal shock absorbers 20*a* and 20*b* on upper and lower ends, respectively Longitudinal shock absorbers 20*a*, 20*b* serve to provide a mounting for perforating gun 154 which is shock mounted both above and below perforating gun 154. Accordingly, any longitudinal acceleration of perforating gun 154 upon detonation will receive a damping effect in each direction through the action of longitudinal shock absorbers 20*a*, 20*b*.

In some systems, it may be desirable to utilize longitudinal shock absorbers of different dimensions. Longitudinal shock absorbers of different dimensions will have different shock absorbing capacities. In shock absorber system 160, there is relatively little suspended mass beneath lower shock absorber 20*b*. Accordingly, it may be desirable to use a lower shock absorber 206 which will provide less resistance to acceleration between the housing and mandrel of the longitudinal shock absorber so as to optimally damp shock to carriers 156*a*, 156*b*.

Radial shock absorber 18 is preferably situated immediately adjacent perforating gun 154 in this embodiment to minimize any radial "whipping" of perforating gun 154 which would cause similar movement in tool string 140.

Gauge carriers 142*a*, 142*b* are situated below packer 144, and are utilized to support relatively sensitive instruments, such as temperature and pressure recorders. Although gauge carriers 142*a*, 142*b* are illustrated immediately below packer 144, it should be readily understood that in alternative embodiments gauge carriers 142*a*, 142*b* may be situated in other positions within the tool string.

Figure 7:
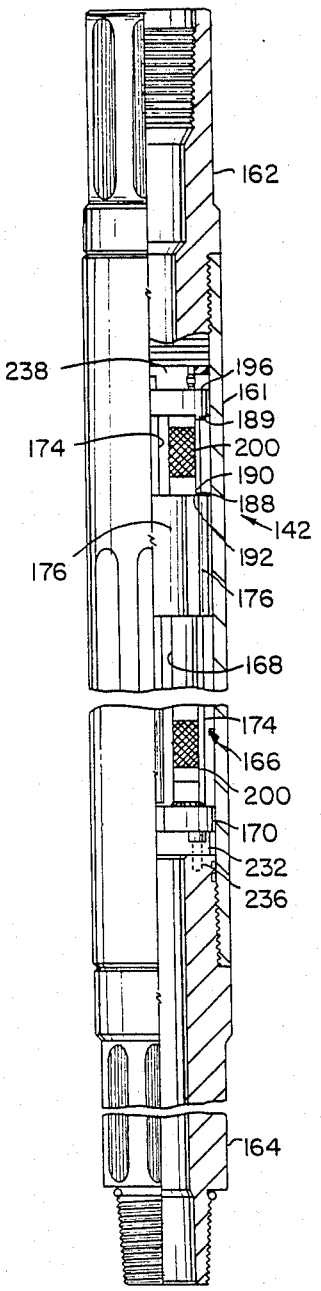
FIG. 7 depicts the gauge carrier of FIG. 6, illustrated in quarter-sectional view.

Referring now to FIG. 7, therein is shown a gauge carrier 142 in accordance with the present invention. In one preferred embodiment, each gauge carrier 142*a*, 142*b* is adapted to hold four cylindrical gauges or instruments of substantial length. The depicted embodiment of gauge carrier 142 is therefore illustrative only, and the depicted components may be adapted to accommodate device of other dimensions or conformities.

Gauge carrier 142 includes a generally cylindrical housing 161 having a box connector 162 threadably coupled at a first end and a pin connector 164 threadably coupled at a second end. Retained within housing 161 between box connector 162 and pin connector 164 is a shock absorbing cage assembly, indicated generally at 166, supporting a plurality of cylindrical gauges 168.

Figure 8:
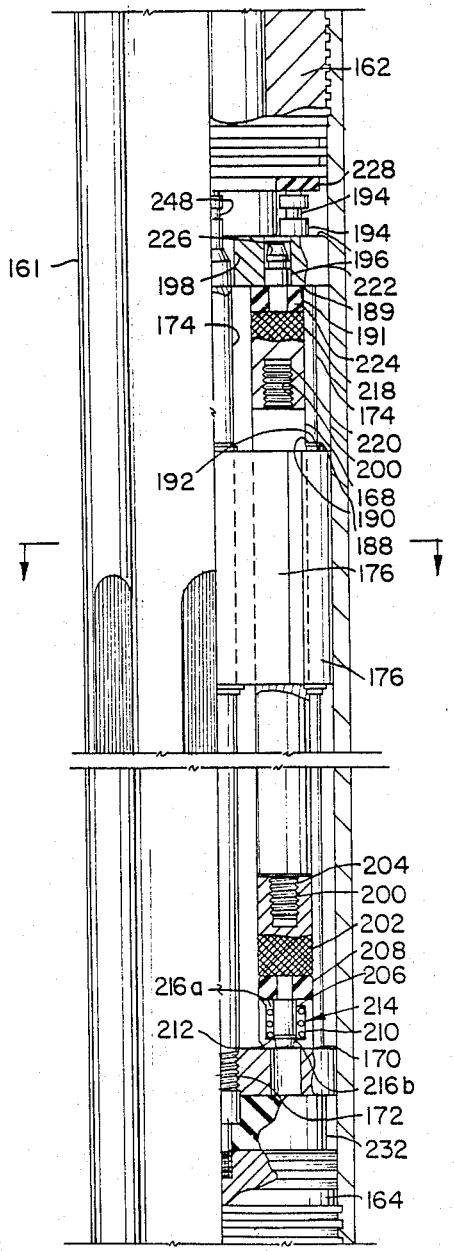
FIG. 8 depicts a portion of the gauge carrier of FIG. 7, in greater detail.
Figure 9:
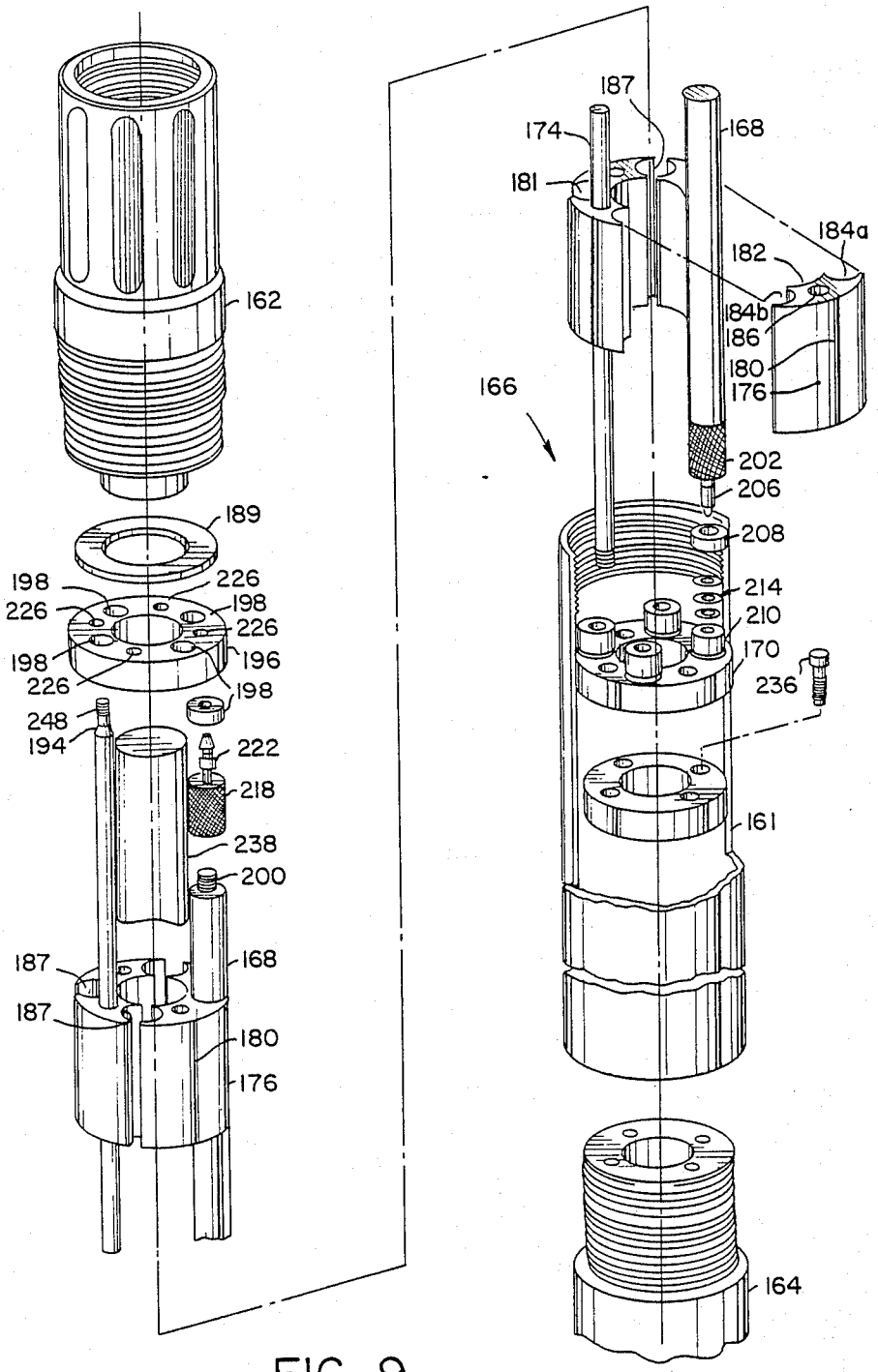
FIG. 9 depicts the gauge carrier of FIGS. 7 and 8, illustrated in an exploded perspective view.

Referring now also to FIGS. 8 and 9, therein is shown in FIG. 8 the portion of gauge carrier 142 containing shock absorbing cage assembly 166, depicted in quarter-sectional view; while in FIG. 9 is shown an exploded view of shock absorbing cage assembly 166, and a gauge 168, showing the relationship of the various types of components included therein.

Shock absorbing cage assembly 166 includes a base plate 170 which contains a plurality of threaded apertures 172. In an embodiment adapted to support four cylindrical gauges, as illustrated, base plate 170 contains four threaded apertures 172, one to threadably couple to each of four tie rods 174. For clarity, only one tie rod 174 and only one gauge 168 are illustrated in FIG. 9. A plurality of spacers 176 are adapted to slidably fit onto tie rods 174. In one preferred embodiment wherein tie rods 174 are approximately six feet long, shock absorbing cage assembly 166 includes 20 spacers 176 arranged in five sets of four, such sets being distributed in generally equal spacings along the length of tie rods 174.

Figure 10:
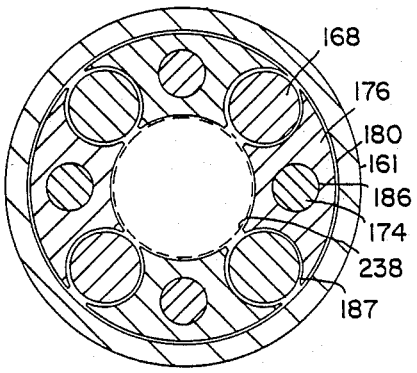
FIG. 10 depicts the gauge carrier of FIG. 8 in cross-section along lines 10—10 in FIG. 8.

Each spacer 176 is preferably formed of a low resilience rubber compound such as 80 durometer, peroxide-cured Hycar, as discussed earlier herein. Referring now also to FIG. 10, each spacer 176 represents an approximately 90° section of a tubular member. Each spacer 176 therefore exhibits a cross-section having an external convex portion 180 and an internal concave portion 182. Each spacer 176 cross-section also exhibits a concave portion on either side, 184*a*, 184*b*, and a central longitudinal aperture 186. Side concave portions 184*a*, 184*b* are configured such that when a set of four spacers 176 are arranged in one plane, with each tie rod 174 extending through central aperture 186 of a spacer 176, side concave portions 184*a*, 184*b* of adjacent spacers 176 will cooperatively substantially define longitudinally extending cylindrical apertures 187. Spacers 176 are dimensioned such that apertures 187 will substantially enclose cylindrical gauges 168.

Spacers 176 are secured in position along tie rods 174 by an appropriate mechanism such as split rings or tru-arc rings 188 (FIG. 7) retained within recesses 190 in tie rods 174. Rubber pads or washers 192 are preferably situated between rings 188 and spacers 176 to fill any tolerance gaps between recesses 190 and spacers 176.

Upper ends 194 of tie rods 174 are retained within support ring 196. Upper ends 194 are configured to telescopingly mate with a first set of apertures 198 in support ring 196. Support ring 196 is retained proximate upper ends 194 of tie rods 174 by mechanisms such as tru-arc rings 189 within recesses 191 in upper ends 194 of tie rods 174.

The above described structures define the basic cage assembly 166 which supports gauges 168. In the illustrated embodiment, gauges 168 have male threaded couplings 200 on each end. Accordingly, lower end fitting 202 includes a female threaded portion 204 adapted to threadably couple to gauge 168. Lower end fitting 202 preferably includes a longitudinal extension 206 which is telescopingly received within an annulus bumper pad 208 and a mounting ring 210. Bumper pad 208 is also preferably formed of a relatively low resilience rubber compound such as 80 durometer, peroxide-cured Hycar, as discussed earlier herein. Mounting ring 210 is preferably a metal ring including a central aperture 212. Mounting ring 210 is securely attached, such as by welding, to base plate 170.

A plurality of O-rings, indicated generally at 214, are preferably housed within mounting ring 210, concentric to longitudinal extension 206 to prevent metal-to-metal contact between extension 206 and mounting ring 210. O-rings rings 214 may be retained within mounting ring 210 by upper and lower lips 216*a*, 216*b*, respectively, formed in mounting ring 210.

At the upper end of gauges 168, shock absorbing cage assembly 166 includes an upper end fitting 218 which includes a female threaded portion 220 adapted to threadably couple to cylindrical gauge 168. Upper end fitting 218 also includes a longitudinal extension 222 which is telescopingly received within an annular bumper pad 224 and in one of a set of second apertures 226 within support ring 196. Bumper pad 224, is preferably formed of a similar low resilience rubber compound as that of which lower bumper pad 208 is formed. As can be seen in FIGS. 7 and 8, extension 222 of upper end fitting 218 preferably extends only within support ring 196. However, upper ends 194 of tie rods 174 extend through support ring 196 and contact an annular pad 228 adjacent shoulder 230 of box connector 162. Annular pad 228 is again formed of the same relatively low resilience rubber compound as disclosed earlier herein.

When cage assembly 166 is placed within housing 160, base plate 170 will rest against a shock absorbing ring 232. Shock absorbing ring 232 is again formed of a relatively low resilience rubber compound as discussed earlier herein. Shock absorbing ring 232 is retained against shoulder 234 of lower pin connector 164 by a plurality of bolts 236.

In particular environments, it is often desirable to include a central sleeve 238 through shock absorbing cage assembly 166. Sleeve 238 will provide a smooth cylindrical path through gauge carrier 142, so as to facilitate the movement of objects such as "go-devils", or detonating bars, through the gauge carrier.

In operation, telescoping mountings at either end of gauges 168 facilitate longitudinal movement of the gauges 168 to absorb longitudinal shock. The accelerations of gauges 168 in either longitudinal direction due to shocks experienced by housing 161 of gauge carrier 142 are damped through the action of bumper pads 208 and 224. Additionally, radial acceleration of the gauges is restrained by the sets of spacers 176. Spacers 176 serve not only to prevent radial metal to metal contact between gauges 168 and housing 160, but also serve to tie gauges 168 together radially to minimize any radial whipping of gauges 168.

As described herein, gauge carrier 142 provides a unique cage assembly for supporting each of the gauges such that no metal-to-metal contact will be made between the gauge and any other component when cage assembly 168 is installed within housing 160. Cage assembly 166 therefore facilitates the preassembling of one or more cage units with gauges which can be selectively placed into a housing 160 as desired.

Figure 11:
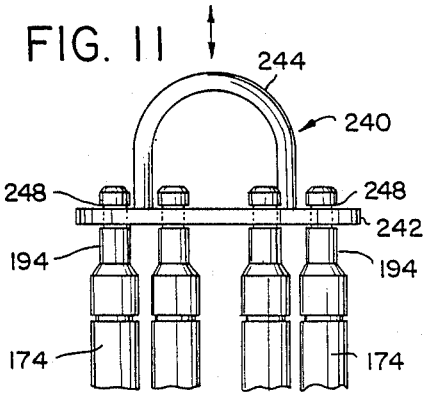
FIG. 11 depicts a mounting tool for the gauge carrier of FIG. 8, illustrated in side view.
Figure 12:
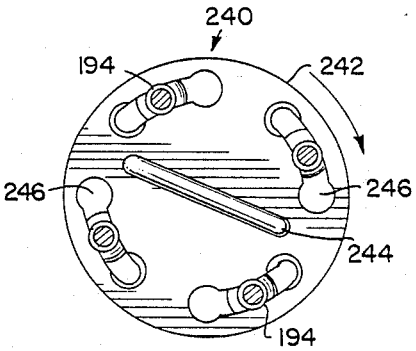
FIG. 12 depicts the mounting tool of FIG. 11 illustrated in top view.

Referring now to FIGS. 11 and 12, therein is shown a bracket 240 for facilitating easy insertion and removal of cage assembly 166 from housing 160. Bracket 240 includes a base plate 242 and a handle 244. Base plate 242 contains a plurality of radially distributed keyslots 246 arranged to engage recesses 248 in upper ends 194 of tie rods 174. By inserting upper ends 194 through keyslots 246 of base plate 242, and rotating base plate 242 with handle 244 bracket 240 grips tie rods 194 at recesses 248 and facilitates the insertion or withdrawal of cage assembly 166 into or out of housing 160.

Figure 13:
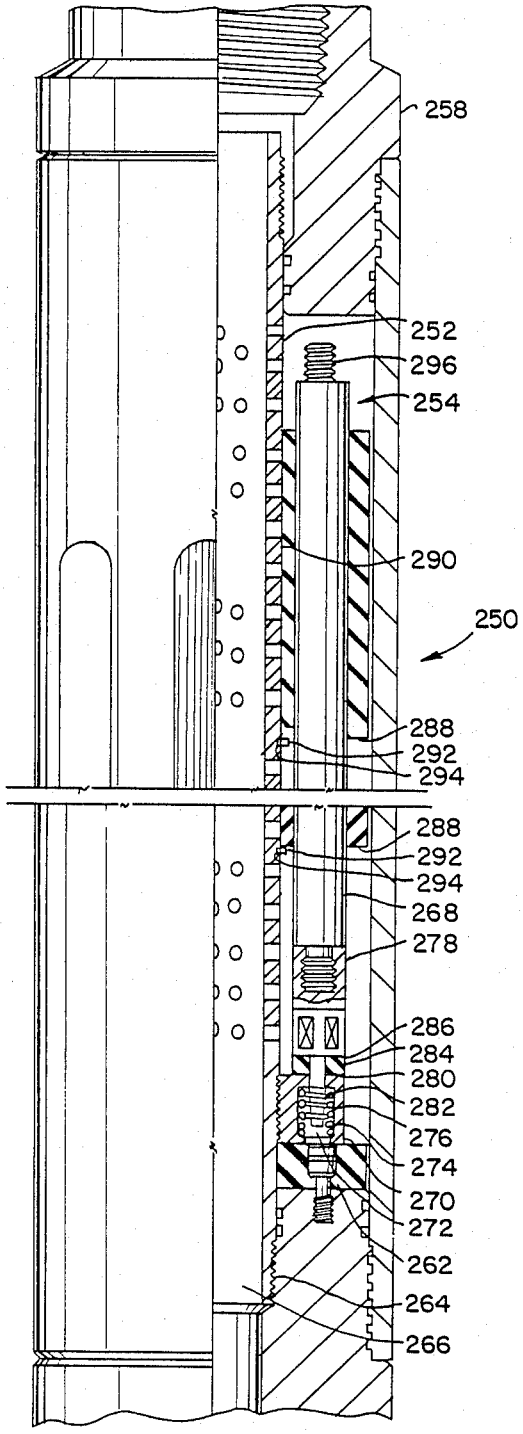
FIG. 13 depicts an alternative embodiment of a carrier in accordance with the present invention.

Referring now to FIG. 13, therein is depicted an alternative embodiment of a gauge carrier 250 in accordance with the present invention. The embodiment of gauge carrier 250 may be of particular use when minimizing the diameter of the gauge carrier is not critical. As with the previous embodiment, gauge carrier 250 includes a housing 256, a box connector 258, and a pin connector 260. Cage assembly 254 of gauge carrier 250, however, utilizes a central support tube 252 as the longitudinal structural member, rather than the tie rods of the previously described embodiment. Also as with the previously described embodiment, an annular bumper pad 262 is secured to pin connector 260. For clarity, only one gauge is illustrated in FIG. 13. It should be readily understood that a number of gauges will typically be supported by cage assembly 254. The number of gauges which may be supported will be determined primarily by the size of the gauges and the diameter of the annular area between central support tube 252 and housing 256.

Cage assembly 254 includes central support tube 252 defining an interior passageway 266. Central support tube 252 may be threadably coupled, as at 264, to pin connector 260. Central support tube 252 is preferably perforated to assure that no pressure differential will be established between interior passageway 266 and the gauges, as illustrated at 268.

Also threadably secured to central support tube 252 is support ring 270. Support ring 270 is an annular member having a plurality of apertures 272 extending therethrough. Each aperture 272 includes a backbore portion 274 which houses a plurality of O-rings 276. As will be apparent from the discussion to follow, these O-rings 276 serve as the retention mechanism for gauges 262. Preferably, six to ten appropriately sized O-rings are housed within backbore 274.

As with the previously described embodiment, a mounting adapter 278 is affixed to gauge 268. As previously discussed herein, where gauge 268 includes a male threaded portion extending therefrom, mounting adaptor 278 will include a female threaded member cooperatively conformed to mate with the male threaded portion of gauge 268. Mounting adapter 278 includes a longitudinal extension 280 having a plurality of frusto conical left hand thread sections, illustrated generally at 282. An annular bumper ring 284 is disposed on extension 280 between shoulder 286 of mounting adapter 278 and support ring 270. Frusto conical extensions 282 are cooperatively sized with O-rings 276 to facilitate the insertion of extension 280, but to prevent the ready removal of extension 280. Thus, mounting adapter 278 and attached gauge 268 are retained within support ring 270, while O-rings 282, extension 280 and annular bumper pad 284 cooperatively facilitate shock isolation of gauge 268.

Because lower mounting assembly 271 secures gauge 268 from vertical removal, upper ends 296 of gauges 268 are not individually retained.

A plurality of annular spacers 288 are preferably utilized along the length of gauges 268 to minimize radial acceleration of gauges 268 along their length. Each annular spacer 288 is preferably formed of a relatively low resilience rubber compound as previously discussed herein. Annular spacers 288 each includes a central aperture 290 to allow annular member 288 to slidably fit over central support tube 252. Annular members 288 are then each preferably retained in place on central support tube 252 by a C-ring 292 which engages recesses 294 in central support tube 252.

In the operation of gauge carrier 250, annular spacers 288 will damp radial movement or acceleration of gauges 268. In reaction to longitudinal forces, a downward longitudinal force will cause acceleration of gauge 268 to be damped through the compression of annular bumber 284. An upward longitudinal acceleration on gauge 268 will be damped by the pull of frusto conical extensions 288 against the resilient mounting of O-rings 282. Accordingly, gauge carrier 250 damps both radial and longitudinal accelerations of gauges 268.

Figure 14:
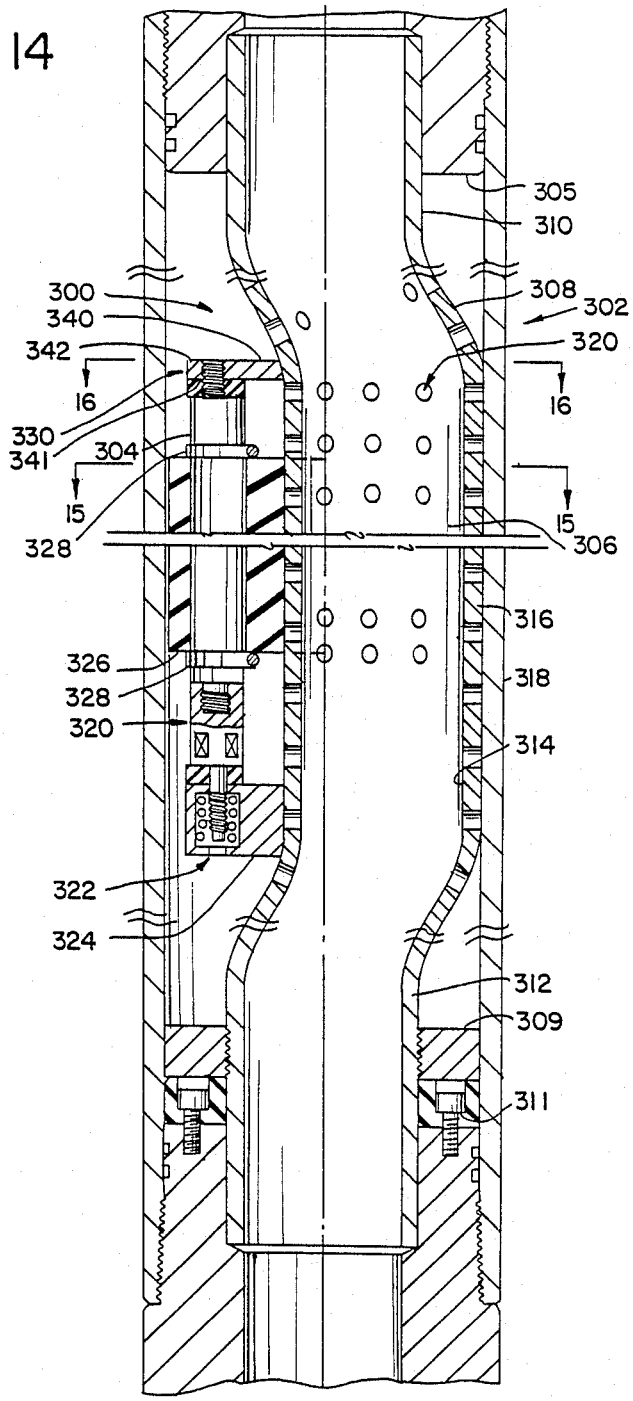
FIG. 14 depicts another alternative embodiment of a carrier in accordance with the present invention.

Referring now to FIG. 14, therein is illustrated a cage assembly 300 of another alternative embodiment of a gauge carrier 302 in accordance with the present invention. Gauge carrier 302 is particularly adapted to carry a small number of gauges 304 in a minimal diametrical area, while still providing a passageway 306 to facilitate the movement of fluid or mechanisms through gauge carrier 302.

Cage assembly 300 includes a support tube 308 which defines passageway 306. Rather than extending continually along the longitudinal axis of gauge carrier 302, support tube 308 is bent, maintaining a constant interior diameter, such that while upper and lower ends, 310 and 312, respectively, are aligned generally along the longitudinal axis of gauge carrier 302, a central portion 314 will be eccentrically located relative to the longitudinal axis. The bends in support tube 308 may be relatively slight, such as on the order of 1–2 degrees, to facilitate the passage of mechanisms through passageway 306. Support tube 208 is preferably conformed such that exterior wall 316 of central portion 314 will lie substantially adjacent at the interior of housing 318. Support tube 308 again contains perforations, indicated generally at 320 to prevent the establishing of a pressure differential between passageway 306 and gauges 304.

Upper end 310 of support tube 308 is slidably retained within box connector 305. Treadably secured to lower end 312 of support tube 308 is a support plate 309. Support plate 309 rests against an annular pad 311 as described with respect to the previous embodiments of gauge carriers.

In gauge carrier 302, gauges are supported by a mounting assembly, indicated generally at 320, which is supported on support tube 308. Mounting assembly 320 is preferably supported diametrically opposite central portion 314 of support tube 308.

Mounting assembly 320 includes a lower mounting member 322 which is operatively configured and functions identically to lower mounting assembly 271 in the embodiment of FIG. 13, with the exception that lower mounting block 324 extends only to one side of support tube 308. Mounting member 314 is preferably securely attached to support tube 308, such as by welding. Lower mounting member 322 may contain mechanisms for retaining as many gauges as a particular design facilitates. As will be apparent from the discussion to follow, the illustrated embodiment of guage carrier is intended to support two gauges.

Figure 15:
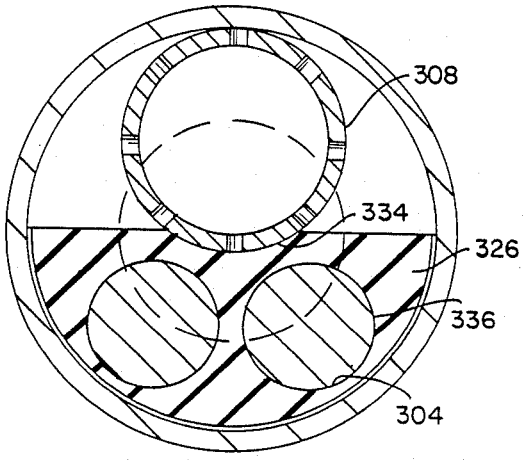
FIG. 15 depicts a carrier of FIG. 14 in cross-section along lines 15—15 in FIG. 14.

Referring also now to FIG. 15, therein is depicted gauge carrier 302 in cross-section along line 15—15 in FIG. 14. Spacers 326 may preferably be of a generally half circle configuration, having a concave portion 334 adapted to cooperatively engage the perimeter of tube 308. In the illustrated embodiment, spacers include two apertures 336 which engage two gages 304. A plurality of spacers 326 are again distributed along the length of gauges 304. Spacers 326 are again preferably formed of a relatively low resilience rubber compound as discussed earlier herein. Spacers 326 may be retained in place along gauges 304 by appropriate mechanisms, such as clamps 328 around gauges 304. As with the previous embodiments, a plurality of spacers 326 will be distributed over the length of gauges 304. An upper mounting assembly 330 may optimally be utilized to retain upper ends 332 of gauges 304 aligned in parallel with the longitudinal axis of gauge carrier 320.

Figure 16:
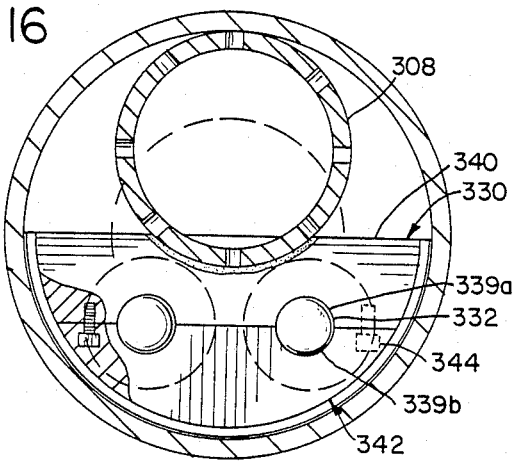
FIG. 16 depicts the carrier of FIG. 14 in cross-section along lines 16—16 in FIG. 14.

Referring also now to FIG. 16, therein is illustrated gauge carrier 302 depicted in cross-section along line 16—16 in FIG. 14. Upper mounting assembly 330 may be any appropriate mechanism. In the illustrated embodiment, upper mounting assembly is a split ring mechanism adapted to retain upper ends 332 of gauges 304. Split ring assembly 330 includes a first portion 340 which is suitably affixed, such as by welding, to support tube 308. First portion 340 contains partial apertures **339*a* for supporting upper ends 332 of gauges 304. A second portion 342 includes complimentary partial apertures 339*b* to encircle upper ends 332 of gauges 304. Second portion 342 is appropriately secured, such as by bolts 344 to first portion 340 to retain upper ends 332 of gauges 304. Annular bumpers 341 are preferably supported concentric to each upper portion 332 of gauges 304 beneath upper mounting assembly 330**. Annular bumpers are preferably conformed of a relatively low resilience rubber compound as discussed earlier herein.

In operation, shock to gauges 304 will be damped by lower mounting assembly 320 in the manner previously described with respect to lower mounting assembly 271 in the embodiment of FIG. 13. Annular bumpers 341 prevent the impacting of gauges 304 against upper mounting assembly 330.

Many modifications and variations may be made in the techniques and structures described and illustrated herein without departing from the scope of the present invention. Accordingly, it should be readily understood that the embodiments shown and discussed herein are illustrative only and are not to be considered as limitations upon the scope of the present invention.

I claim:

1. Apparatus for protecting a component utilized in a borehole from shock, said apparatus comprising:

a housing for encasing said component; and a cage assembly received within said housing, said cage assembly for supporting said component encased within said housing, said cage assembly comprising:

a first shock absorbing assembly at a first longitudinal end of said component;

a second shock absorbing assembly at the other longitudinal end of said component;

a shock absorbing element along the length of said component, said shock absorbing element for restricting radial movement of said component;

a base member; and a support member extending from said base member, said support member having a first end coupled to said base member.

2. The apparatus of claim 1, wherein said first shock absorbing assembly comprises:

a supporting surface; and a deformable relatively low resilience member.

3. The apparatus of claim 2, wherein said deformable relatively low resilience member is formed of a rubber material.

4. The apparatus of claim 1, wherein said apparatus is adapted to protect a plurality of components.

5. The apparatus of claim 1, wherein said shock absorbing element comprises a plurality of segments at least partially formed of a shock absorbing material, said segments adapted to cooperatively restrict the radial movement of the component.

6. The apparatus of claim 1, wherein said first shock absorbing assembly comprises a telescoping coupling between said component and said base member, and a shock absorbing medium between said component and said base member.

7. The apparatus of claim 1, wherein the second shock absorbing assembly comprises:

a top member, a telescoping coupling between said component and said top member, and a shock absorbing medium between said component and said top member.

* * * * *